US008113380B2

(12) United States Patent
Goren

(10) Patent No.: US 8,113,380 B2
(45) Date of Patent: Feb. 14, 2012

(54) ERGONOMIC SERVING TRAY

(76) Inventor: Dafna Goren, Ganei Yehuda Savyon (IL)

( * ) Notice: Subject to any disclaimer, the term of this patent is extended or adjusted under 35 U.S.C. 154(b) by 0 days.

(21) Appl. No.: 11/959,681

(22) Filed: Dec. 19, 2007

(65) Prior Publication Data

US 2008/0164177 A1 Jul. 10, 2008

Related U.S. Application Data

(63) Continuation of application No. PCT/US2006/000740, filed on Jun. 22, 2006.

(60) Provisional application No. 60/693,075, filed on Jun. 23, 2005.

(51) Int. Cl.
*B65D 25/28* (2006.01)

(52) U.S. Cl. ..... 220/755; 220/771; 206/557; 206/564

(58) Field of Classification Search ..... 206/557, 206/564; 220/771, 755
See application file for complete search history.

(56) References Cited

U.S. PATENT DOCUMENTS 567,087 A * 9/1896 Fitzgerald et al. ..... 294/11
1,321,145 A * 11/1919 Price ..... 211/60.1
1,544,972 A * 7/1925 Gebelein ..... 220/23.6
2,295,860 A * 9/1942 Oliver ..... 294/172
2,700,284 A * 1/1955 Lyon, Jr. ..... 220/23.8
2,932,437 A * 4/1960 Wilcox ..... 229/402
3,941,286 A * 3/1976 Perkinson ..... 294/172
D251,102 S * 2/1979 Box ..... D7/553.1
4,219,144 A 8/1980 Hagelberg
4,638,908 A * 1/1987 Baitz et al. ..... 206/0.8
4,746,057 A 5/1988 Wagner
D305,192 S * 12/1989 van Erkel ..... D7/555
5,062,531 A * 11/1991 Coy ..... 206/564
5,076,438 A 12/1991 Aronson
5,085,391 A * 2/1992 Berger et al. ..... 248/311.2
5,111,960 A * 5/1992 Zilliox ..... 220/575
D326,799 S * 6/1992 Vanderzell ..... D7/549
5,152,398 A * 10/1992 Forestal et al. ..... 206/561
(Continued)

FOREIGN PATENT DOCUMENTS

DE 1984225 4/1968
(Continued)

OTHER PUBLICATIONS

International Search Report published May 31, 2007 for PCT/IL2006/000740 filed Jun. 22, 2006.

(Continued)

*Primary Examiner* — Anthony Stashick
*Assistant Examiner* — Christopher McKinley
(74) *Attorney, Agent, or Firm* — The Law Office of Michael E. Kondoudis

(57) ABSTRACT

An ergonomic serving tray with a unique design, which allows the user to lift, carry, and set down said ergonomic serving tray with a single hand, without tilting the ergonomic serving tray, comprising an ergonomic serving tray 100 equipped with at least one leg 106 that elevates the tray, allowing the user to easily insert a single hand under the ergonomic serving tray and lift it, and which is further equipped with a unique grip 108 that is ergonomically shaped to comfortably increase both the user's lifting capacity and the user's control over the ergonomic serving tray, said grip being located substantially adjacent to the center of gravity, to facilitate lifting, balancing, and carrying of the ergonomic serving tray.

11 Claims, 13 Drawing Sheets

U.S. PATENT DOCUMENTS

| | | | | | |
|---|---|---|---|---|---|
| 5,184,750 | A | * | 2/1993 | Moller | 220/575 |
| 5,207,743 | A | * | 5/1993 | Costarella et al. | 220/574 |
| 5,294,000 | A | * | 3/1994 | Yanuzzi | 206/562 |
| 5,323,910 | A | * | 6/1994 | van de Graaf, Jr. | 206/557 |
| 5,335,787 | A | * | 8/1994 | Finchum et al. | 206/564 |
| 5,346,070 | A | * | 9/1994 | McSpadden | 206/561 |
| 5,551,593 | A | * | 9/1996 | Wiens | 220/575 |
| 5,598,944 | A | * | 2/1997 | Aragona | 220/575 |
| 5,607,077 | A | | 3/1997 | Torkelson | |
| 5,662,240 | A | * | 9/1997 | Norris | 220/574 |
| 5,797,495 | A | * | 8/1998 | Lerrick | 206/557 |
| D398,481 | S | * | 9/1998 | Brown et al. | D7/554.2 |
| 5,803,305 | A | | 9/1998 | Perlis et al. | |
| 5,850,910 | A | * | 12/1998 | Broyles et al. | 206/1.8 |
| 5,947,011 | A | * | 9/1999 | Xu | 99/357 |
| 5,960,982 | A | * | 10/1999 | Perlis et al. | 220/574 |
| 6,129,235 | A | * | 10/2000 | Creske | 220/575 |
| 6,145,906 | A | * | 11/2000 | Wright et al. | 294/172 |
| D455,316 | S | * | 4/2002 | Carpenter | D7/549 |
| 6,450,341 | B1 | | 9/2002 | Krupa et al. | |
| 6,691,890 | B1 | * | 2/2004 | Persson | 220/575 |
| D499,936 | S | | 12/2004 | Wiedmeyer et al. | |
| 7,000,799 | B1 | * | 2/2006 | Hamre | 220/556 |
| 7,284,675 | B2 | * | 10/2007 | Chang | 220/574 |
| 7,347,469 | B1 | * | 3/2008 | Renganathan et al. | 294/55 |
| D572,536 | S | * | 7/2008 | Cox | D7/553.1 |
| D581,740 | S | * | 12/2008 | Ingle | D7/549 |
| 2006/0163259 | A1 | * | 7/2006 | Congiu et al. | 220/556 |
| 2007/0215512 | A1 | * | 9/2007 | Bellissimo | 206/557 |

FOREIGN PATENT DOCUMENTS

| | | |
|---|---|---|
| DE | 7202617 | 9/1972 |
| EP | 1438915 | 7/2004 |
| FR | 2683708 | 11/1991 |
| GB | 276384 | 8/1927 |
| GB | 2266447 | 11/1993 |
| GB | 2367233 A | 4/2002 |
| NL | 1010697 C | 4/2000 |
| WO | WO2004004520 | 1/2004 |

OTHER PUBLICATIONS

Written Opinion of the International Searching Authority published Dec. 23, 2007 for PCT/IL2006/000740 filed Jun. 22, 2006.

International Preliminary Report on Patentability published Dec. 24, 2007 for PCT/IL2006/000740 filed Jun. 22, 2006.

European Supplementary Search Report dated Aug. 22, 2008 issued for EP 06745179.9.

* cited by examiner

ERGONOMIC SERVING TRAY

CROSS-REFERENCE TO RELATED APPLICATIONS

This application is a continuation of PCT/IL2006/00740, filed Jun. 22, 2006, which claims the benefit under 35 U.S.C. §119(e) of Provisional Application No. 60/693,075, filed Jun. 23, 2005.

FIELD OF INVENTION

This invention relates generally to serving devices, and specifically to serving trays that are designed with ergonomic improvements to be handled with a single hand.

BACKGROUND OF THE INVENTION

Serving trays are widely known and commonly used. The usual tray sits flat against a surface, has a planar carrying surface and some sort of graspable edge, or handles. It is often necessary to use two hands to lift and set down the tray, particularly when the tray is loaded with objects. Heavy trays are difficult enough to manage with two hands, let alone with a single hand. Even skilled servers require two hands to lift and set down such trays. Furthermore, trying to carry these trays with one hand requires a great deal of skill.

A number of trays in the art have made various attempts to improve the design of serving trays, in order to facilitate their carrying.

U.S. Pat. No. 5,076,438, U.S. Pat. No. 5,797,495, NL1010697C. and GB2266447 all offer serving trays that provide improved grips that facilitate balancing the trays. Nevertheless, none of these responses provides a solution for lifting and setting down the trays with a single hand.

U.S. Pat. No. 5,152,398 and WO2004004520 both present snack trays that are easy to carry in one hand. However, the designs require that the thumb be inserted into a hole that restricts movement. This may force users to hold the tray in an unnatural or uncomfortable position. Furthermore, the indentations and cutouts in the planar area severely restrict the usable carrying surface, thereby limiting the usefulness of such trays.

EP1438915 relates to a serving tray with a handle protruding upwards from the middle of the tray, enabling the tray to be carried with one hand. However, the central placement of the handle interferes with and restricts the usable surface area of the tray.

U.S. Pat. No. 3,941,286 discloses a serving tray having an opening through which the server's hand is inserted, allowing the server to lift and carry the tray with one hand. In spite of this, such a tray may be difficult to balance because the tray's gripping point is not aligned with the tray's center of gravity. Additionally, once the hand is inserted into the opening, it will be difficult for the server to reposition the tray or switch the tray to the other hand.

There is clearly a need for a new serving tray that can easily, comfortably, and naturally be lifted, carried, and set down with a single hand, even when the tray is fully loaded white leaving the second hand free to perform another task, and which additionally has a large carrying surface. It would be further useful if said tray were stackable for compact storage and of a simple, ergonomic, and inexpensive design.

SUMMARY OF THE INVENTION

In light of the above shortcomings in many serving trays, it is an objective of the present invention to provide an improved serving tray that the user can lift, carry, and set down with a single hand, without tilting the tray.

It is another objective of the present invention to provide a new serving tray with a raised ergonomic grip that allows the user to comfortably, securely, and naturally grasp the serving tray. The raised ergonomic grip is situated along a portion of an edge of said tray, which portion may be closest to the center of gravity. It is yet another objective of the present invention to provide the user with a more comfort and more controllable tray.

In some embodiments of the present invention, these objectives are achieved by providing an ergonomic grip that is substantially a saddle-like depression. In some other embodiments, an ergonomic grip may be enhanced with one or more concavities to facilitate thumb placement.

It is a further objective of the present invention to provide a tray shaped such that the gripping point of said tray may be situated adjacent to the center of gravity in order to increase the stability of the tray while holding the tray by the raised ergonomic grip.

BRIEF DESCRIPTION OF THE DRAWINGS

These and further features and advantages of the invention will become more clearly understood in light of the ensuing descriptions of several embodiments thereof, given by way of example only, with reference to the accompanying drawings, wherein—

DESCRIPTION OF THE INVENTION

Presented herein is an ergonomic serving tray 100 with a unique structural design that enables the user to lift, carry, and set down said tray with a single hand, even when said tray 100 is loaded to capacity, without tilting said tray 100. For purposes of this document, a serving tray may be defined as an open holder with a substantially planar upper carrying surface on which items may be placed, a level underside, and a rim defining the perimeter of the tray that provides additional rigidity. An ergonomic serving tray 100 of the present invention further comprises a contoured gripping area for lifting said ergonomic serving tray 100, and at least one raised section that enables the user to insert a hand under said ergonomic serving tray 100.

Figure 1:
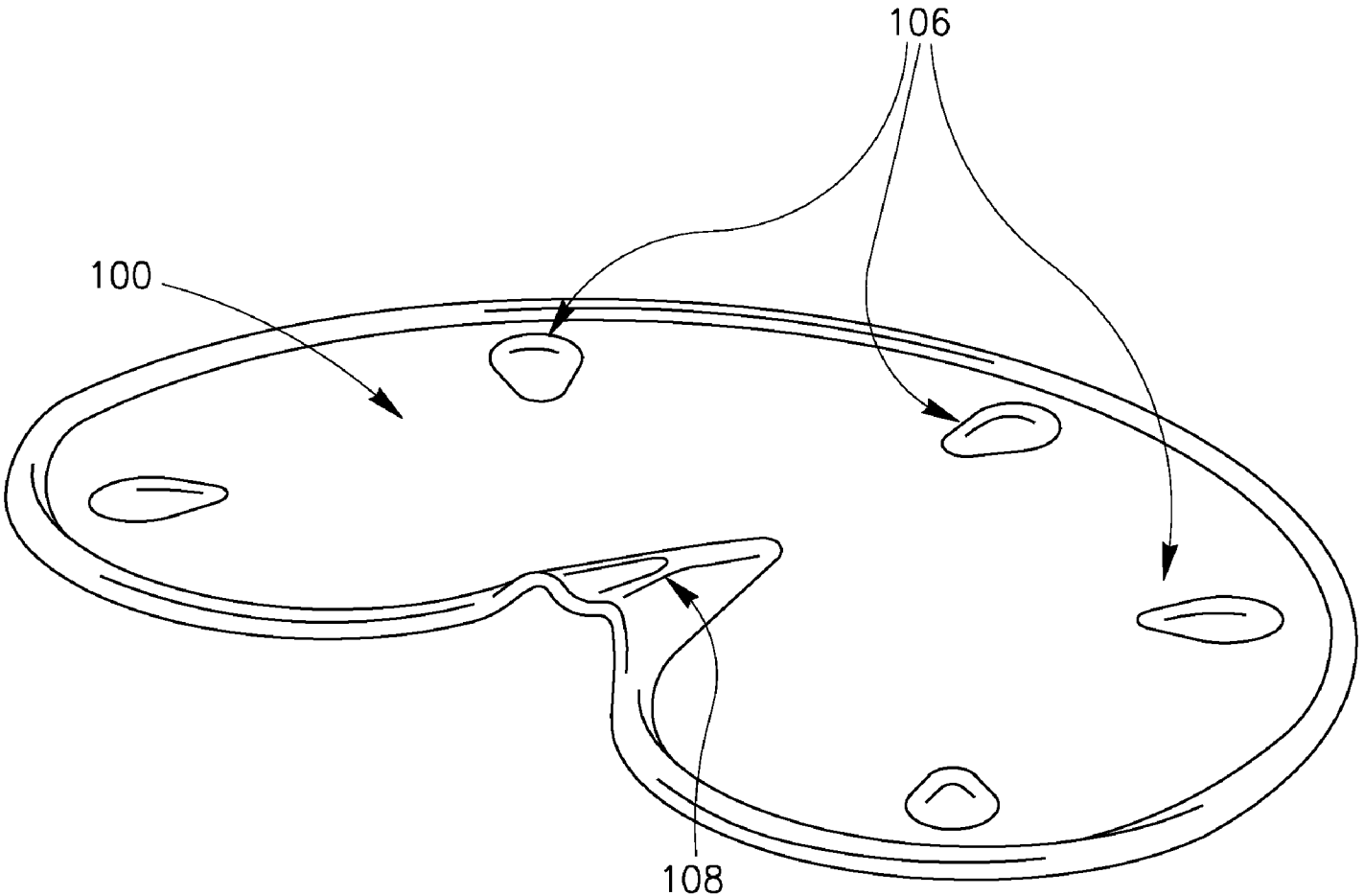
FIG. 1 is a perspective view of an ergonomic serving tray in accordance with an embodiment of the present invention.
Figure 2:
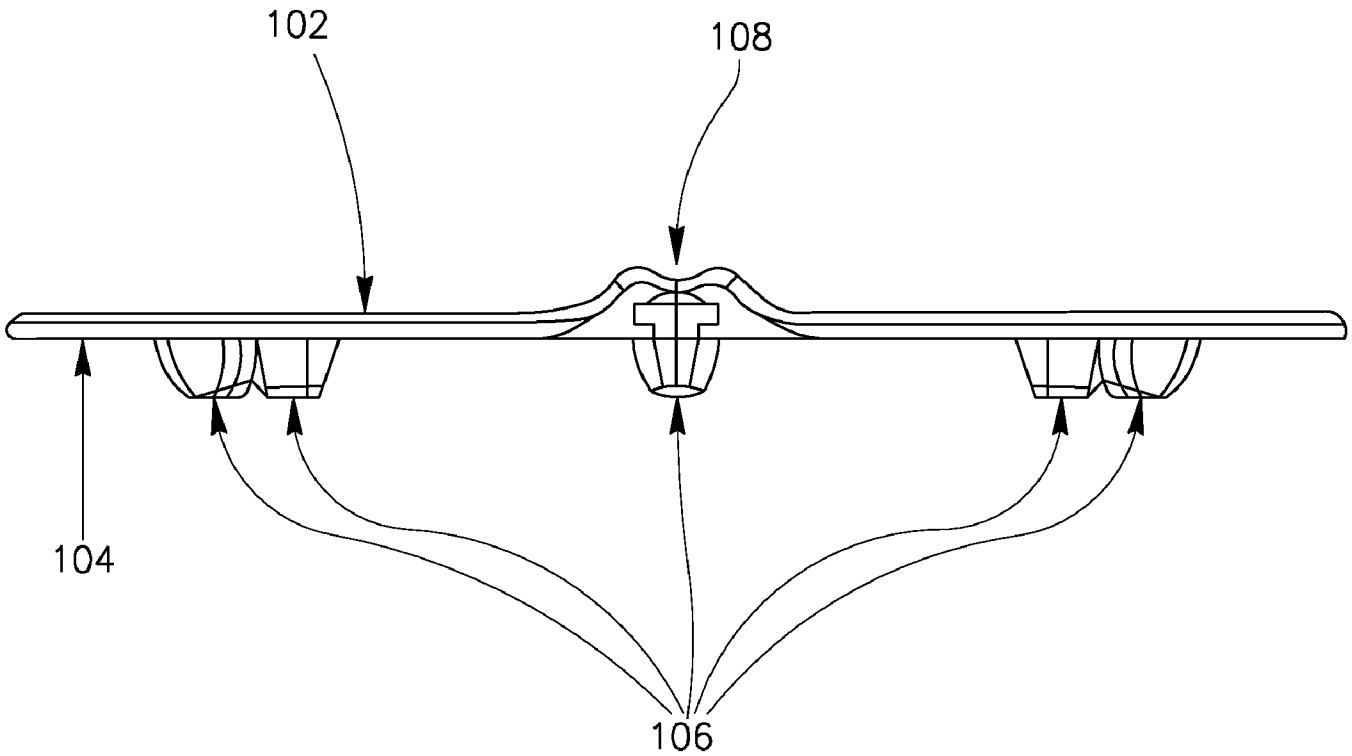
FIG. 2 is a front view of the ergonomic serving tray of FIG. 1.
Figure 3:
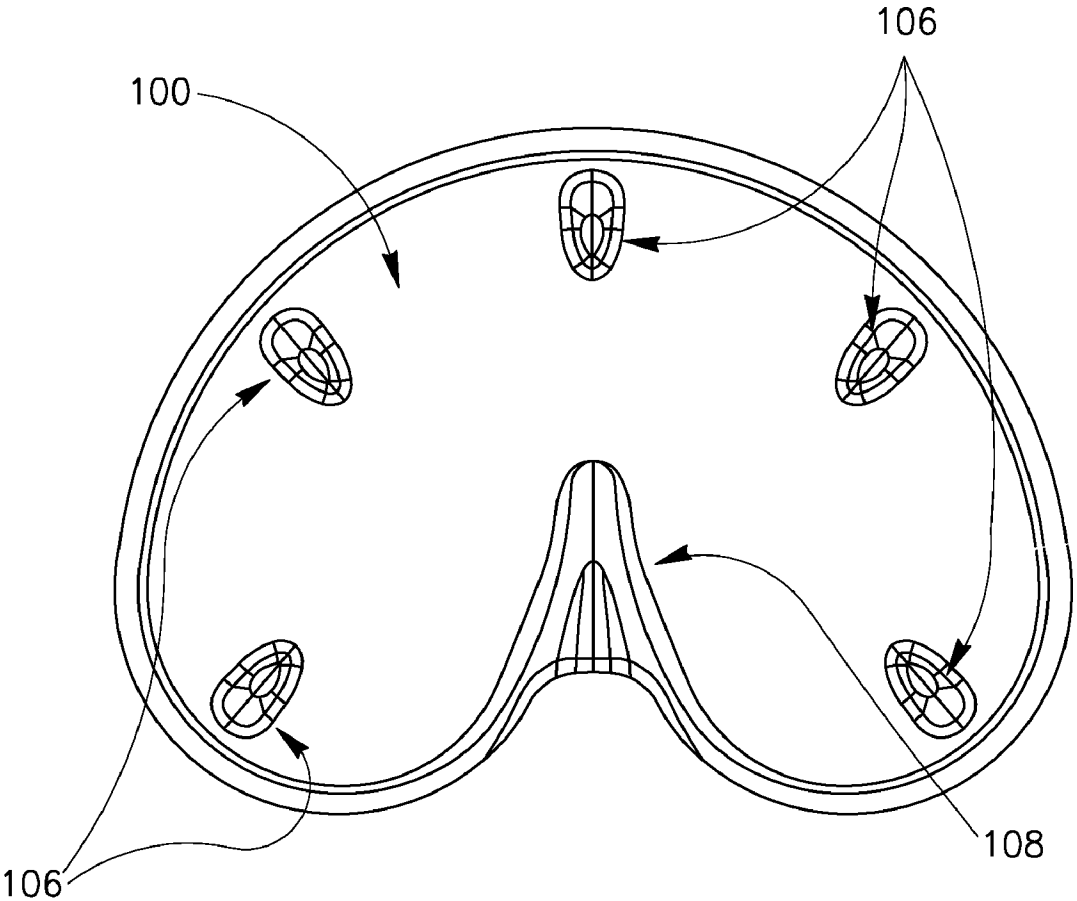
FIG. 3 is a top view of the ergonomic serving tray of FIG. 1.
Figure 15:
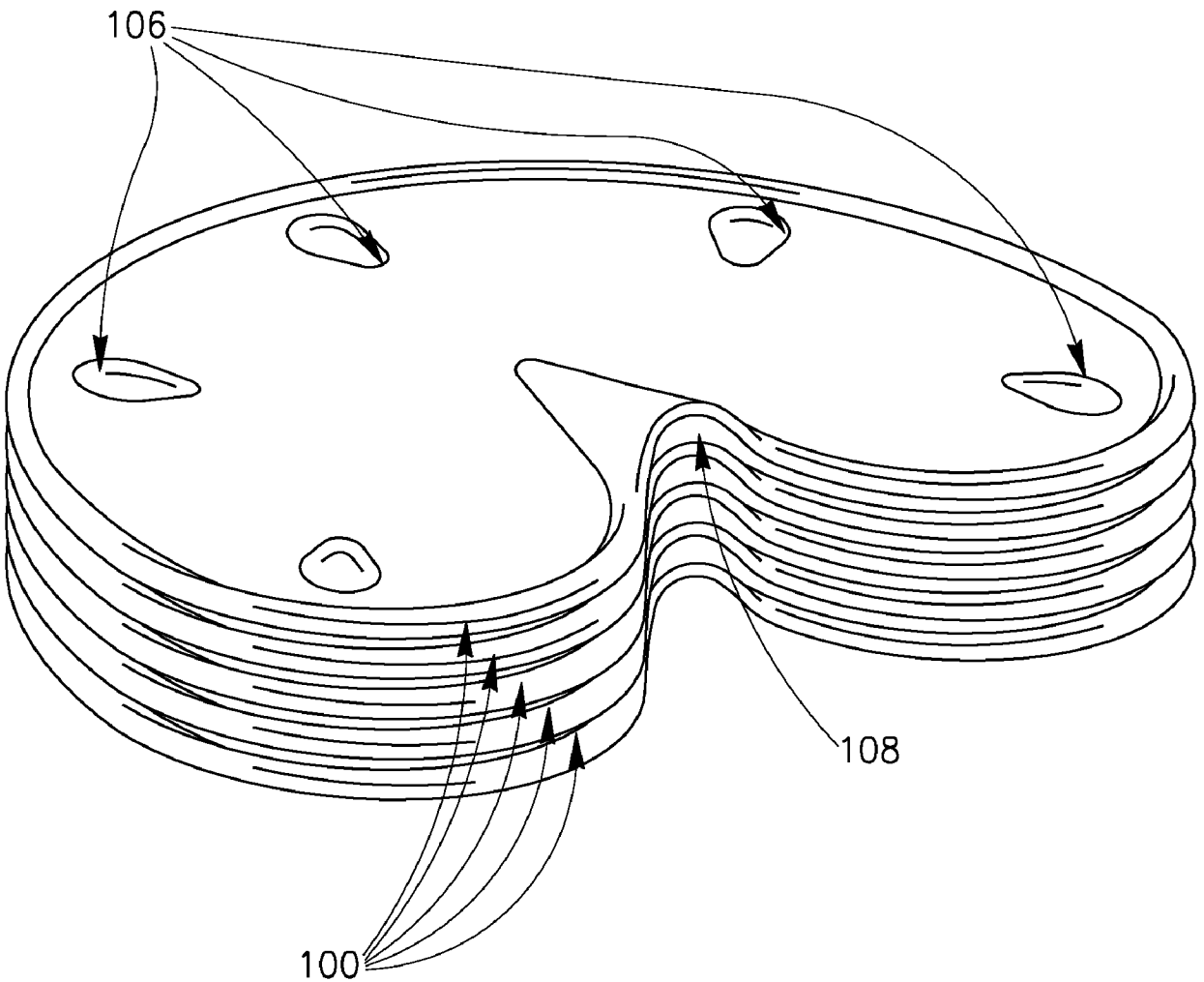
FIG. 15 is a perspective view of a plurality of ergonomic serving trays of FIG. 1, stacked.

In accordance with some embodiments of the present invention, shown in the perspective, front, and top views in FIGS. 1, 2, and 3 respectively, the raised section of said ergonomic serving tray 100 may be achieved by incorporating a plurality of legs 106, which protrude from the underside surface 104 of ergonomic serving tray 100. Legs 106 maintain the underside surface 104 of ergonomic serving tray 100 above the surface on which ergonomic serving tray 100 may be set, allowing the user to easily insert a single hand under ergonomic serving tray 100 and lift ergonomic serving tray 100. According to such an embodiment, legs 106 may be strategically positioned along the perimeter of ergonomic serving tray 100 so that ergonomic serving tray 100 will not tilt or fall over when resting on a surface. The total number, size, and shape of legs 106 may vary according to the size of ergonomic serving tray 100. According to the embodiment described in FIGS. 1, 2, 3, 4, and 15, there are five legs 106, substantially evenly spaced along the perimeter of ergonomic serving tray 100. This configuration is seen in FIGS. 1, 3, and 15.

Figure 14:
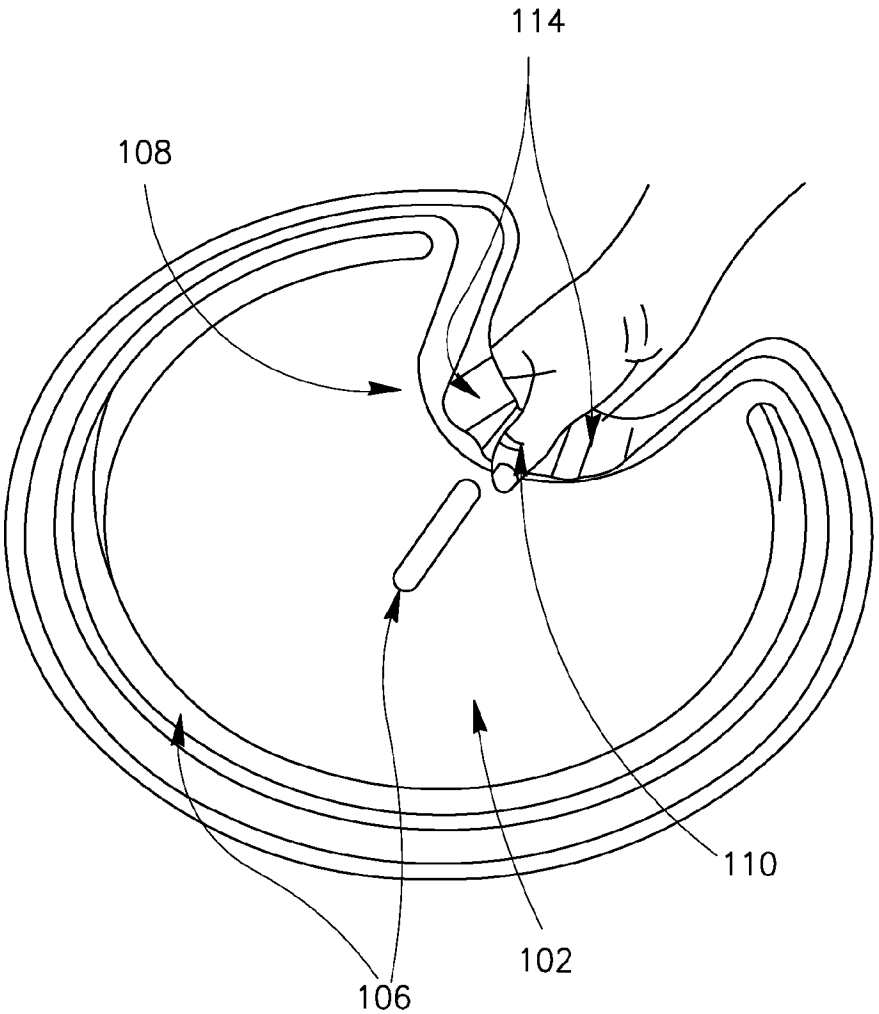
FIG. 14 is a perspective view of the ergonomic Serving tray of FIG. 10 as it sits in the hand of the user.

According to some other embodiments, ergonomic serving trays 110 may be equipped with legs 106 as described in FIG. 14, wherein a continuous leg 106 follows the contour of the outer edge of ergonomic serving tray 100. An additional leg 106 positioned in the center of ergonomic serving tray 100 may provide further stability.

According to some embodiments, legs 106 may be hollow. This hollowed out shape may allow a plurality of ergonomic serving trays 100 to stack together, as shown in FIG. 15, for compact and convenient storage. Another benefit offered by legs 106 shaped thusly is that when liquids spill onto ergonomic serving tray 100, they will run into the hollow part of legs 106, eliminating the need for a high rim and allowing for the possibility of a lower, more aesthetically pleasing rim around ergonomic serving tray 100.

A useful feature of the present invention is a grip 108, which has been ergonomically shaped to safely and comfortably increase both the user's lifting capacity and the user's control over ergonomic serving tray 100. This ergonomic grip 108 extends from the outer edge of ergonomic serving tray 100 in towards the center of ergonomic serving tray 100. Grip 108 is dimensioned so that a portion of the user's hand sits within grip 108 and the thumb 110 sits over grip 108. The shape, location, and size of grip 108 may substantially maximize the useable surface area of ergonomic serving tray 100.

In some embodiments, grip 108 may be drawn upward, culminating in a concave, saddle-like rise, and may be somewhat wider and taller at the outer edge of ergonomic serving tray 100, tapering in towards the inner end. Such a configuration may be seen in FIGS. 1, 2, 3, 4, and 15.

In accordance with some other embodiments, described in the perspective, front, section, and top views in FIGS. 5, 6, 7, and 8 respectively, rip 108 may comprise a raised, angled area under which the user's palm and fingers 112 sit and a raised thumb-supporting depression 114 centered on grip 108 within which the thumb 110 sits. According to such a configuration, grip 108 may also function to create the aforementioned raised area. Such a grip 108 may be useful for an ergonomic serving tray 100 that may be used for carrying, for example, unbalanced loads as may be encountered in, for example, a self-serve or fast food restaurant and may also be used in such settings where the user may use an ergonomic serving tray 100 as an eating surface.

In accordance with yet other embodiments, described in the perspective, front, section, and top views in FIGS. 10, 11, 12, and 13 respectively, grip 108 may comprise an indented, raised area under which a portion of the user's hand sits and three or more thumb-supporting depressions 114 distributed along grip 108 within which the thumb 110 sits. Configuring thumb-supporting depressions 114 thusly allows the user to easily position and reposition thumb 110 as the load on carrying surface 102 changes. An ergonomic serving tray 100 with such a grip 108 may be useful for an ergonomic serving tray 100 that may be used for carrying, for example, heavy loads such as plates, as may be encountered in, for example, a bar or a busy restaurant.

According to embodiments of the present invention, grip 108 of ergonomic serving tray 100 is constructed in such way that the pressure exerted by the user's thumb 110 acts as a counterbalance to ergonomic serving tray 100, increasing the stability and balance of ergonomic serving tray 100. Additionally, grip 108 provides improved handling and grasping of ergonomic serving tray 100, preventing ergonomic serving tray 100 from slipping out of the user's hand.

Figure 4:
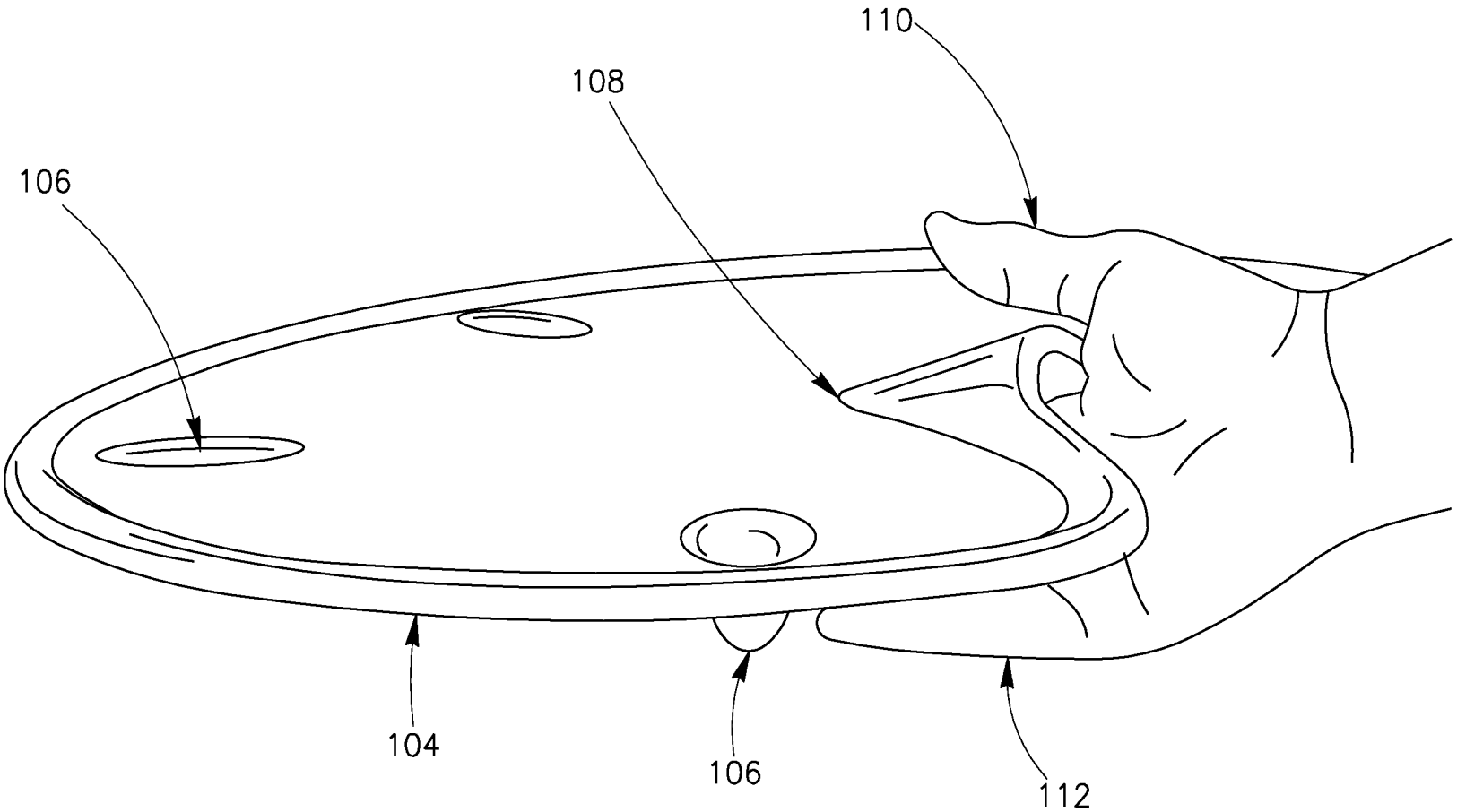
FIG. 4 is a perspective view of the ergonomic serving tray of FIG. 1 as it sits in the hand of the user.
Figure 5:
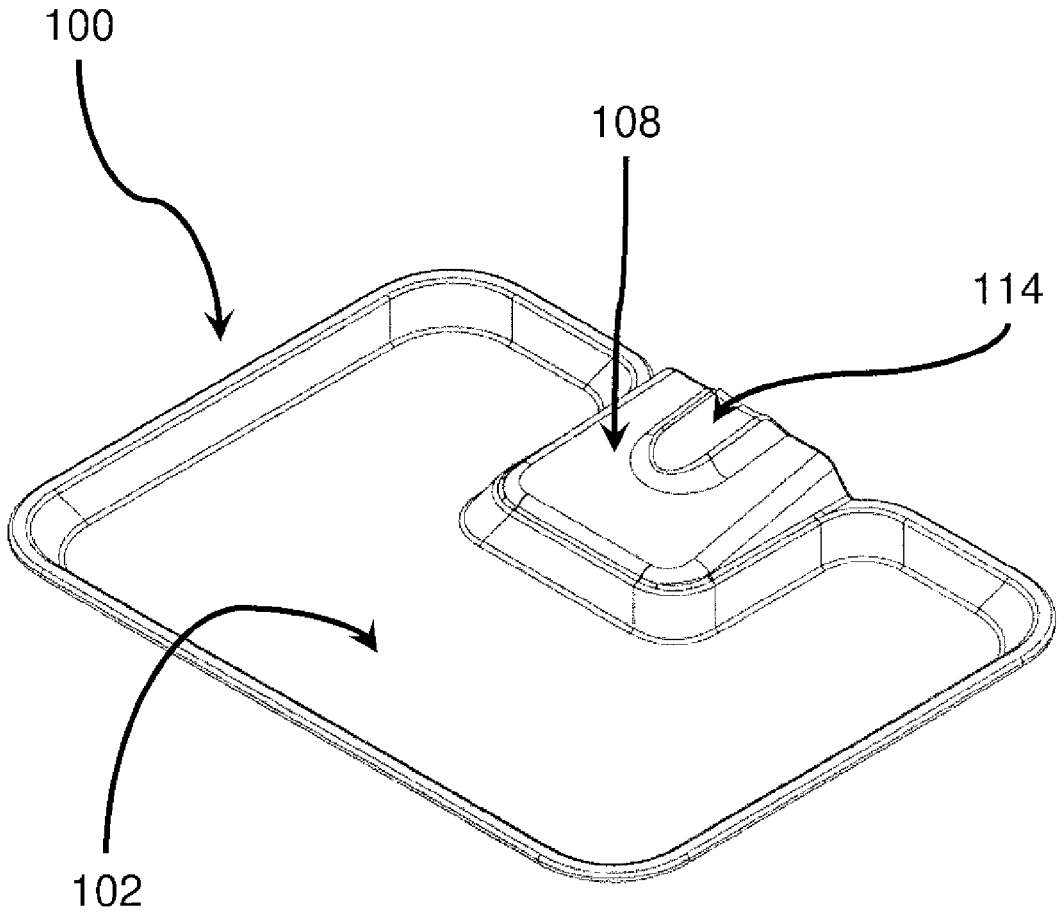
FIG. 5 is a perspective view of a an ergonomic serving tray in accordance with another embodiment of the present invention.
Figure 6:
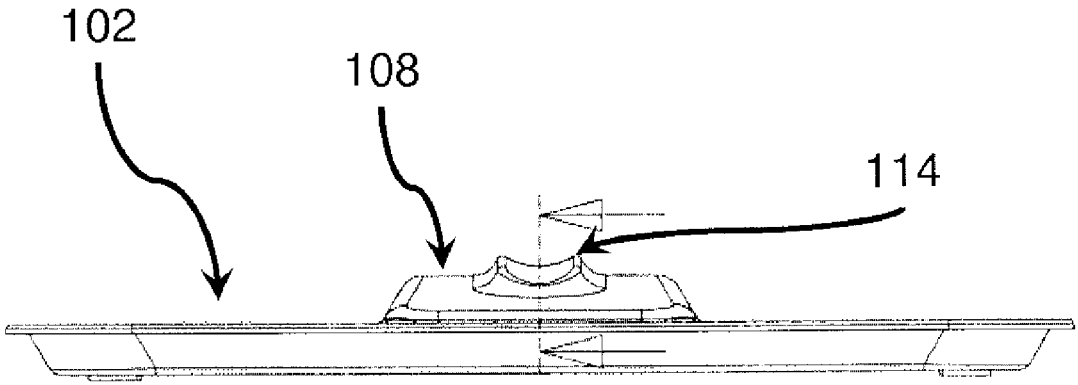
FIG. 6 is a front view of the ergonomic serving tray of FIG. 5.
Figure 7:
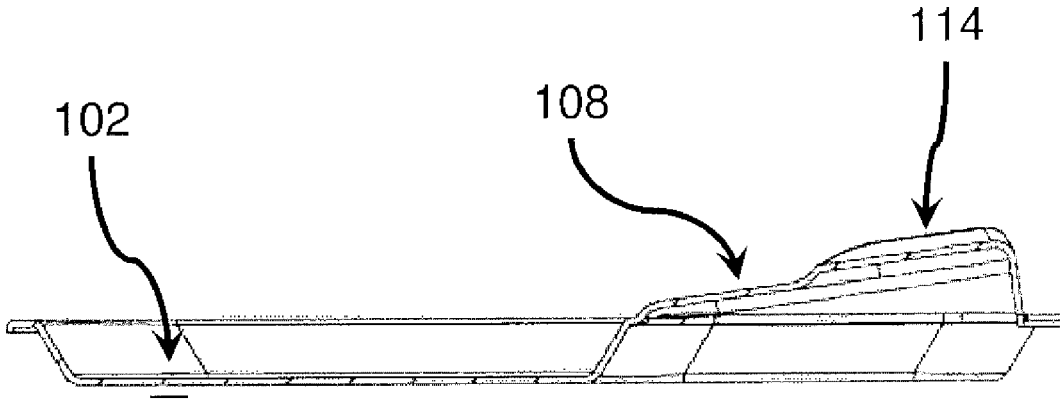
FIG. 7 is a sectional view of the ergonomic serving tray of FIG. 5.
Figure 8:
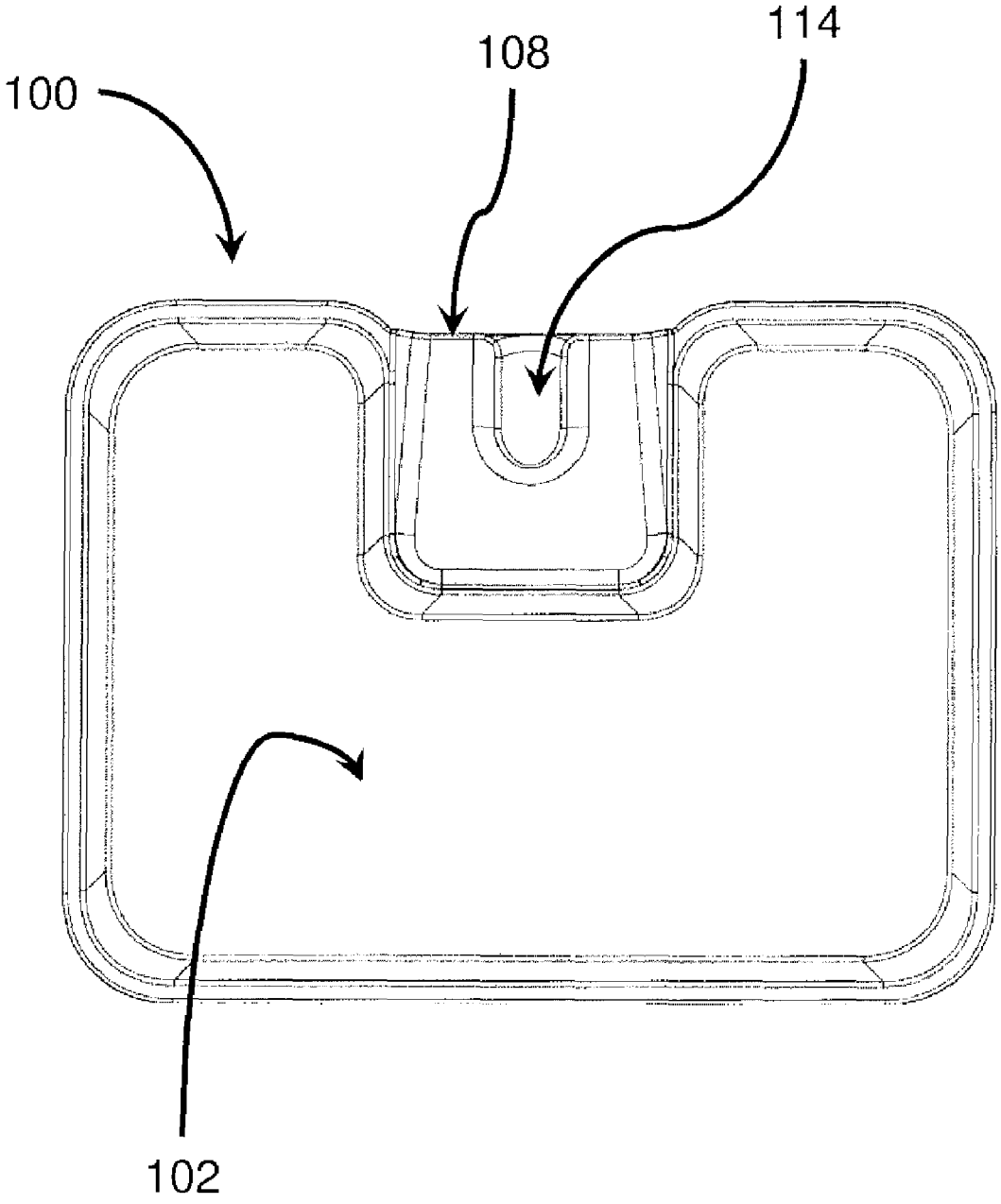
FIG. 8 is a top view of the ergonomic serving tray of FIG. 5.
Figure 9:
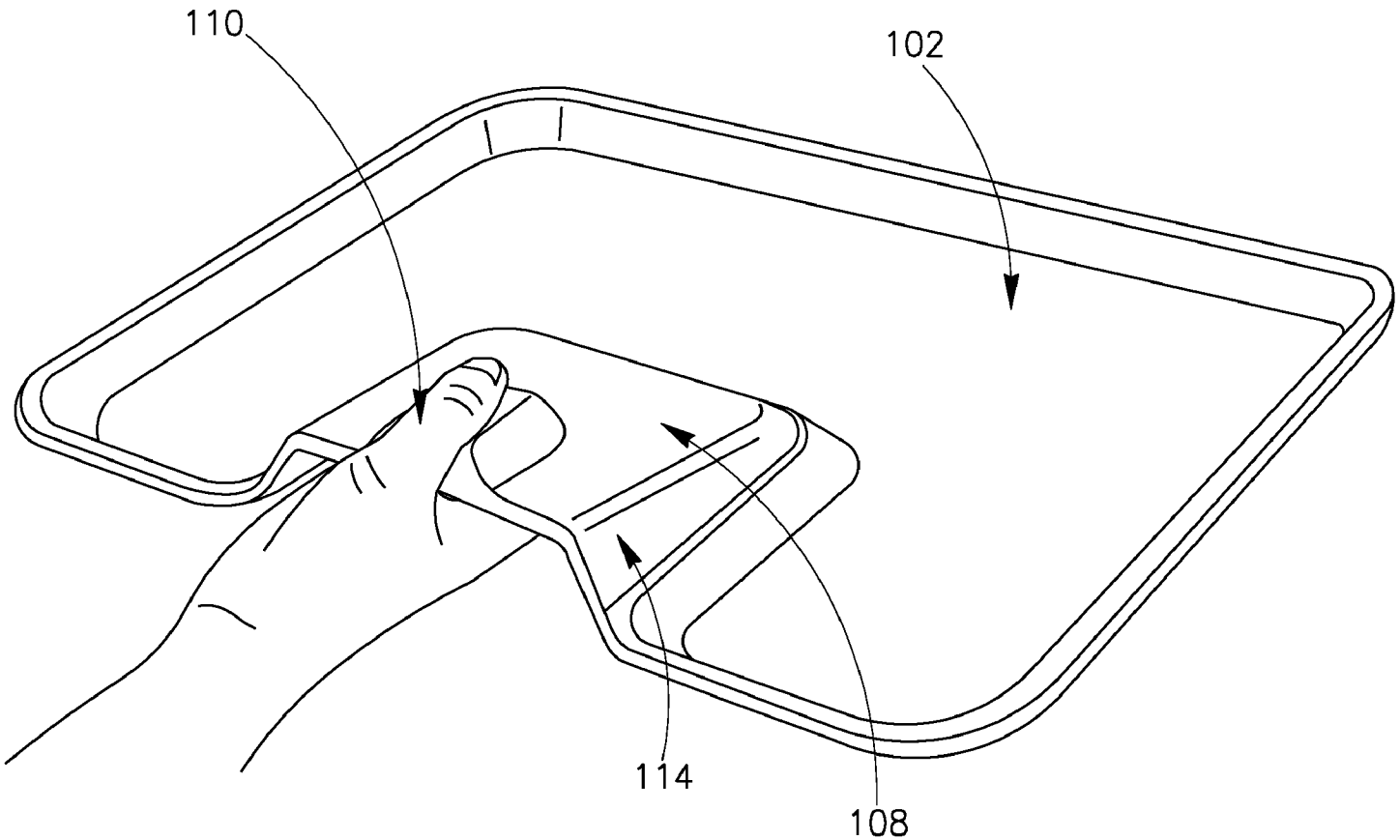
FIG. 9 is a perspective view of the ergonomic serving tray of FIG. 5 as it sits in the hand of the user.
Figure 10:
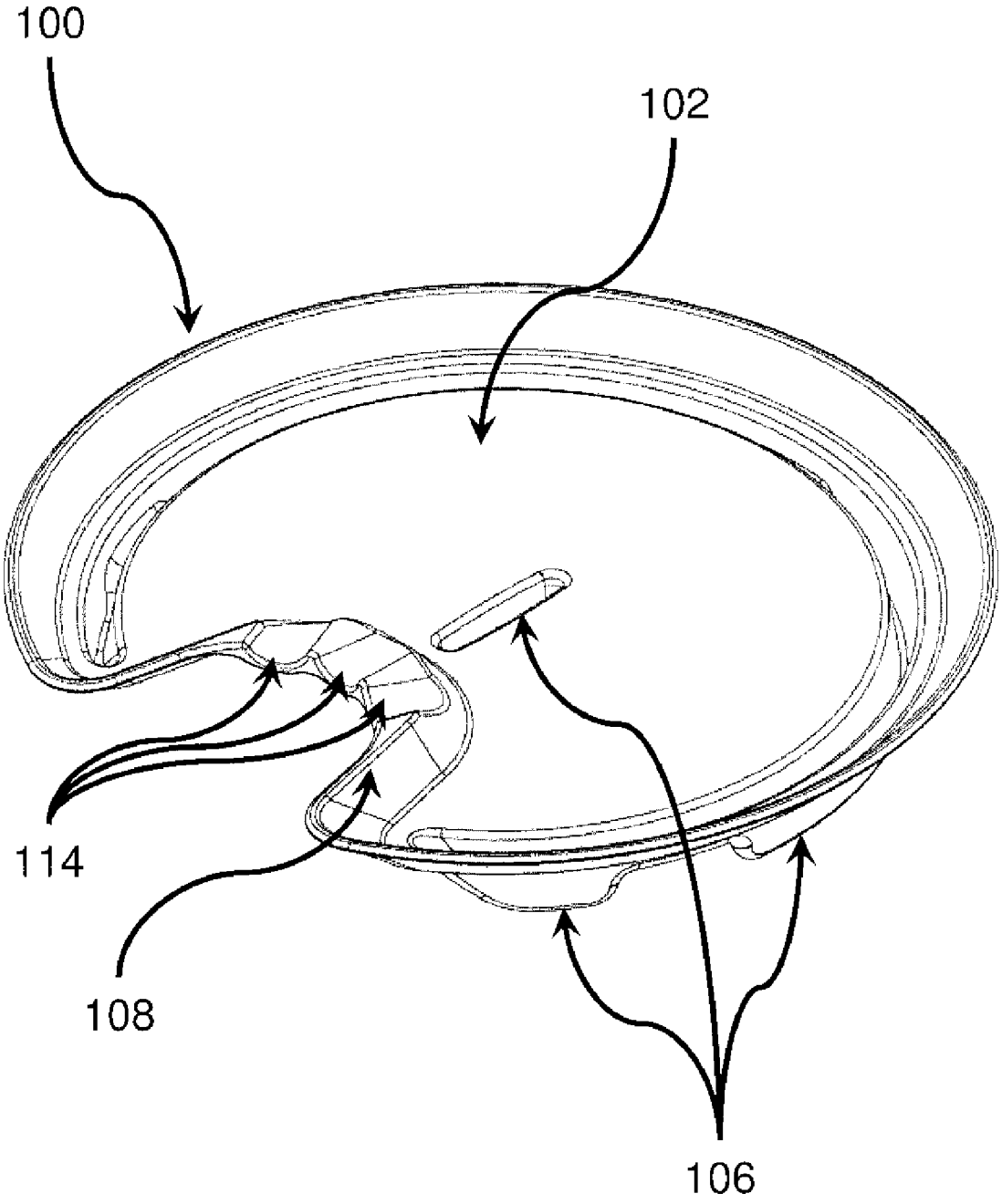
FIG. 10 is a perspective view of an ergonomic serving tray in accordance with a further embodiment of the present invention.
Figure 11:
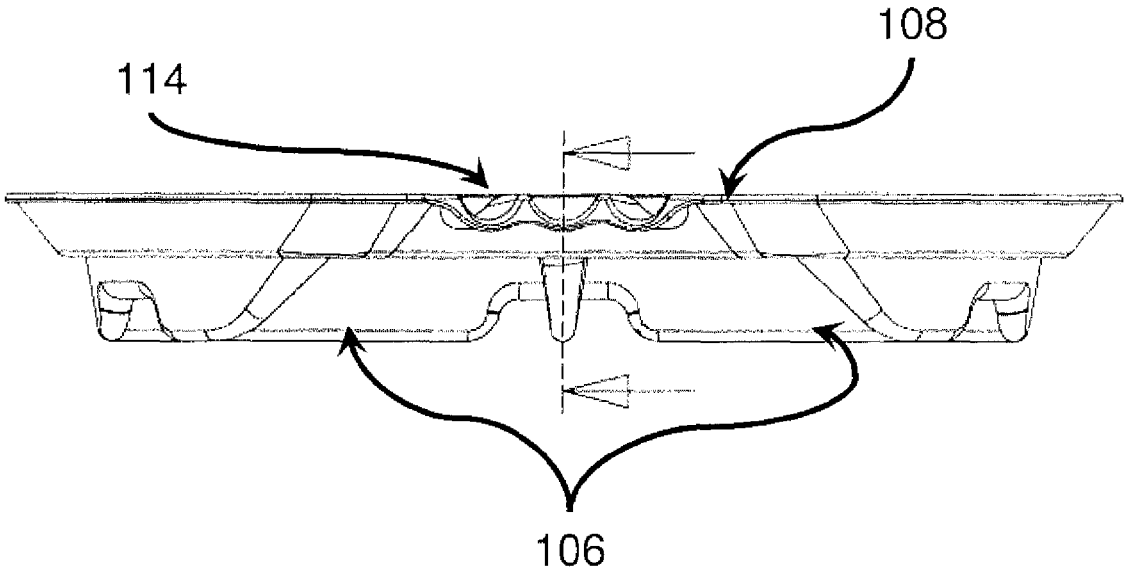
FIG. 11 is a front view of the ergonomic serving tray of FIG. 10.
Figure 12:
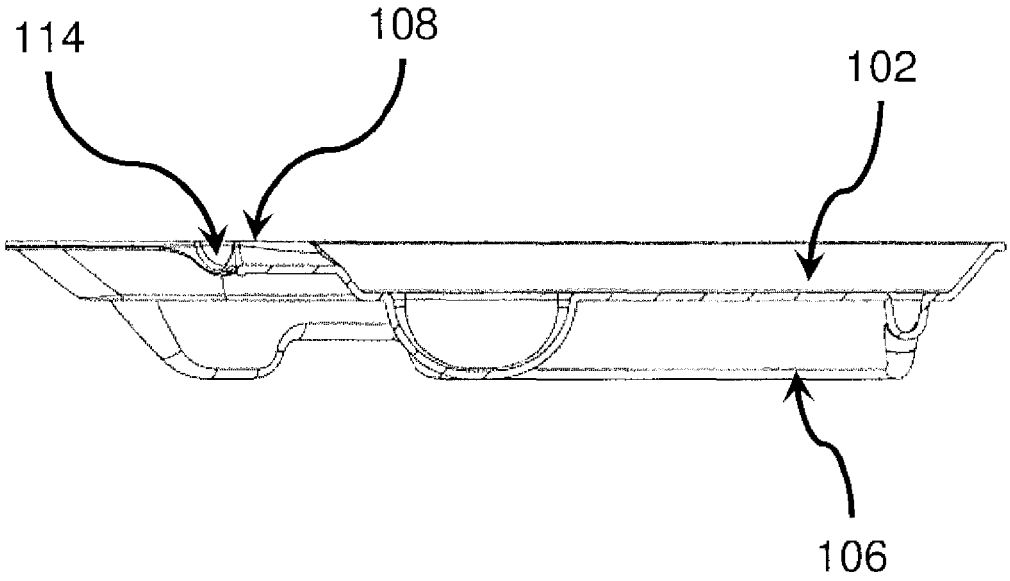
FIG. 12 is a sectional view of the ergonomic serving tray of FIG. 10.

When the user's hand is positioned generally parallel to underside surface 104 of ergonomic serving tray 100, as shown in FIGS. 4, 9, and 14, ergonomic serving tray 100 may be supported at carrying surface 102 by positioning thumb 110 on grip 108, and by resting underside surface 104 of ergonomic serving tray 100 on fingers 112 and, optionally, a portion of the palm of the hand.

Another important feature of the present invention is that ergonomic serving tray 100 is equally suited for use with the left hand and the right hand. Either hand will fit naturally and securely around grip 108.

Figure 13:
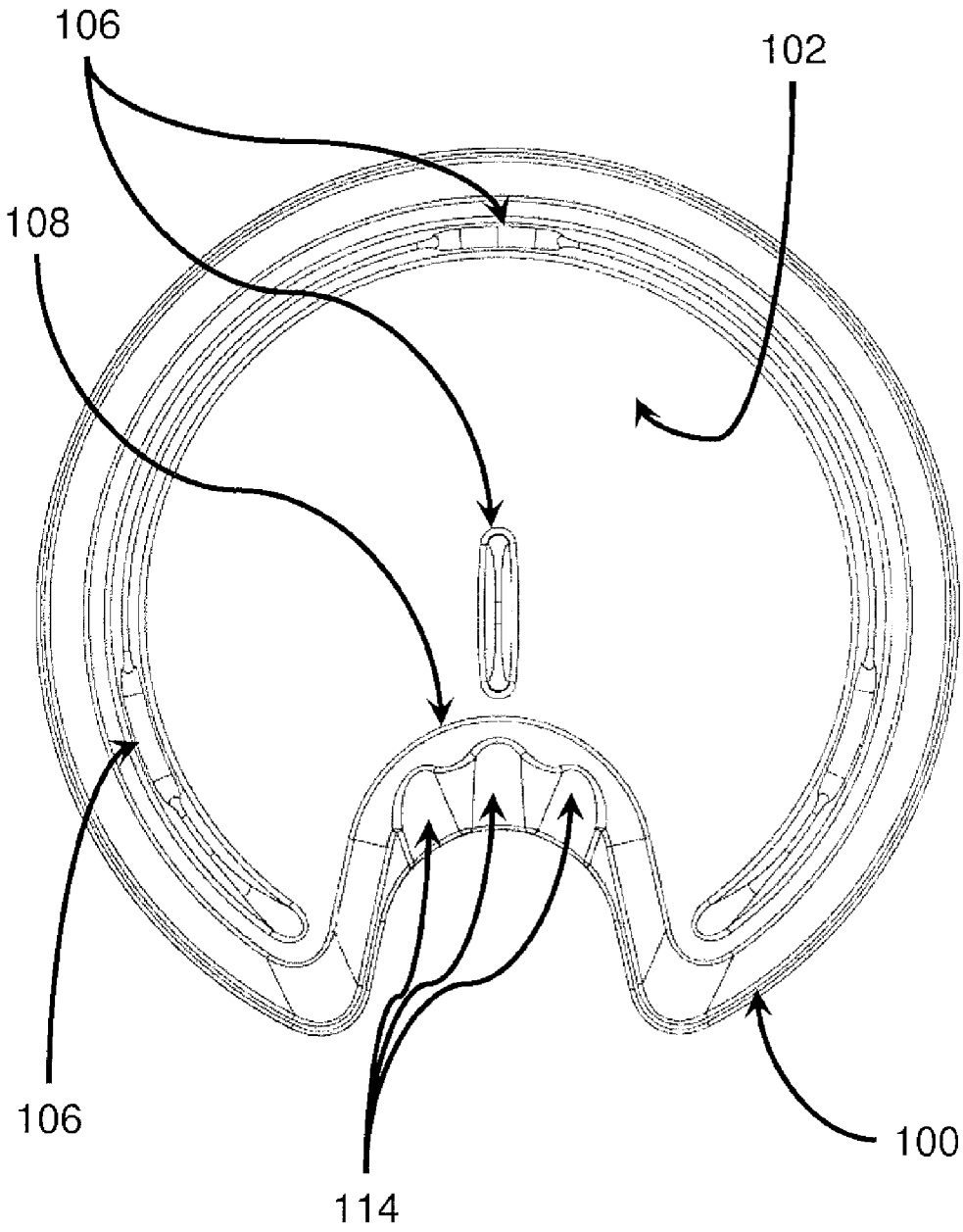
FIG. 13 is a top view of the ergonomic serving tray of FIG. 10.

According to some embodiments of the present invention, the inner end of ergonomic grip 108 may be located substantially adjacent to the center of ergonomic serving tray 100 and may therefore also be at a point closest to the center of gravity of ergonomic serving tray 100, as described in FIGS. 2, 3, and 13, thereby facilitating the grasping, lifting, balancing, and carrying of ergonomic serving tray 100, regardless of the load that ergonomic serving tray 100 bears. Additionally, the shape of grip 108 may be such that thumb 110 is positioned substantially above fingers 112, making it possible to maneuver freely in any direction while naturally maintaining the balance of ergonomic serving tray 100.

Ergonomic serving tray 100 is very simple to grip and to use. In order to more fully describe the present invention, the following describes a mode of use. As seen in FIG. 4, the hand of the user fits naturally around grip 108. According to some embodiments, thumb 110 rests over the saddle-like rise at the top of grip 108, as shown in FIG. 4, and underside surface 104 of ergonomic serving tray 100 sits comfortably on fingers 112. In some other embodiments, thumb 110 rests within a thumb-supporting depression 114, as shown in FIGS. 9 and 14. The web between the thumb 110 and a finger 112 fits snugly against the outer edge of grip 108. When the hand is thus positioned, the counterforce of thumb 110 against fingers 112 allows the user to more naturally grasp ergonomic serving tray 100 and gives the user greater control over ergonomic serving tray 100. Furthermore, the ergonomic shape of grip 108 makes ergonomic serving tray 100 equally suited for left-handed and right-handed use.

An embodiment of ergonomic serving tray 100 may be in the shape of a trapezoid. Another embodiment of ergonomic serving tray 100 may be in the shape of a six-sided polygon, such as a convex, irregular hexagon. Yet another embodiment of ergonomic serving tray 100 may be in the shape of a modified rectangle, wherein at least one corner has been trimmed off. Ergonomic serving tray to according to other embodiments may take other shapes, including an ellipse, a circle, a triangle, a rectangle, or a free-form shape.

In some embodiments, ergonomic serving tray 100 may be made of acrylic. There is also the option of manufacturing the present invention in any other suitable materials, such as plastic, wood, aluminum, and stainless steel. In some embodiments of the invention, some portions of ergonomic serving tray 100 may be denser than other portions of ergonomic serving tray 100, which may further assist in aligning grip 108 of ergonomic serving tray 100 with the center of gravity.

In accordance with any embodiment of the present invention, the rim of ergonomic serving tray 100 may optionally be raised to assist in preventing items from slipping off carrying surface 102.

For added rigidity and strength, there is the option of adding ribs to any embodiment of the present invention. This option may be especially useful for ergonomic serving trays 100 that are manufactured in larger sizes.

While the invention has been described with respect to a limited number of embodiments, these should not be construed as limitations on the scope of the invention, but rather as exemplifications of some of the embodiments. Those skilled in the art will envision other possible variations, modifications, and applications that are also within the scope of the invention. Accordingly, the scope of the invention should not be limited by what has thus far been described, but by the appended claims and their legal equivalents.

What is claimed is:

1. An ergonomic serving tray that allows a user to grasp comfortably and naturally said serving tray, said tray comprising:

a load carrying surface;

a first gripping surface that includes a thumb-supporting depression partially bounded by two raised sidewalls, the depression comprising a curved channel that is configured to accept an unbent thumb, has a curved, substantially semi-circular cross-section, and has an open end at the perimeter of the tray the sidewalls being parallel to each other along a portion of their respective lengths and having outer surfaces that taper away from the thumb-supporting depression and toward a second gripping surface, the outer surfaces being curved at a degree that is substantially identical to a degree of the curve of the channel the second gripping surface that is raised and angled relative to the load carrying surface, is disposed under the first gripping surface, widens in a direction away from the perimeter of the tray, and defines a gripping area that is dimensioned and configured to permit a user to ergonomically place and spread the user's fingers in gripping area when the user's thumb is either accommodated in the thumb-supporting depression or adjacent to the thumb-supporting depression and against a tapered sidewall, wherein said first gripping surface is raised relative to, and located above, the second gripping surface in a terraced manner.

2. The ergonomic serving tray of claim 1 wherein said tray is in the shape of an ellipse.

3. The ergonomic serving tray of claim 1 wherein said tray is in the shape of a circle.

4. The ergonomic serving tray of claim 1 wherein said tray is in the shape of a rectangle.

5. The ergonomic serving tray of claim 1 wherein said tray is in the shape of a trapezoid.

6. The ergonomic serving tray of claim 1 wherein said tray is in the shape of a six-sided polygon.

7. The ergonomic serving tray of claim 1, further comprising ribs across the bottom of the tray, wherein the rib construction increases the rigidity and strength of the tray.

8. An ergonomic serving tray that allows a user to grasp comfortably and naturally said serving tray, said tray comprising:

a load carrying surface;

a first gripping surface that includes a thumb-supporting depression partially bounded by two raised sidewalls, the depression comprising a curved channel that is configured to accept an unbent thumb, has a curved, substantially semi-circular cross-section, and has an open end at the perimeter of the tray the sidewalls being parallel to each other along a portion of their respective lengths and having outer surfaces that taper away from the thumb-supporting depression and toward a second gripping surface, the outer surfaces being curved at a degree that is substantially identical to a degree of the curve of the channel the second gripping surface that is raised and angled relative to the load carrying surface, and is disposed under the first gripping surface.

9. The ergonomic serving tray of claim 1, wherein said tray further comprises at least two legs attached to a lower side of said second gripping surface.

10. The ergonomic serving tray of claim 8, wherein said tray further comprises at least two legs attached to a lower side of said tray.

11. An ergonomic serving tray that allows a user to grasp comfortably and naturally said serving tray, said tray comprising:

a first gripping surface; and a second gripping surface, wherein said first gripping surface is located above the second gripping surface at a predefined distance in a terraced manner, wherein said first gripping surface comprises a thumb-supporting depression for enabling a user to place his thumb in said thumb-supporting depression, said thumb supporting depression includes an elongated channel shaped portion having one open portion at the circumference of the tray and another elongated open portion for receiving a thumb of a user, said channel shaped portion is formed by two side walls each said side wall protrudes from said first gripping surface in a manner which allows supporting the thumb at each side of each said side wall, thereby allowing the user to select one of multiple holding positions of the thumb, wherein said protruding side walls allow balancing said tray weight when the tray is carried in each of said multiple holding positions of the thumb, wherein said second gripping surface, located below said first gripping surface enables the user to place and spread his other fingers there beneath to hold said tray ergonomically wherein the thumb is located above the other gripping fingers of the user's same hand at a distance defined by the distance between the surfaces to allow ergonomically holding and balancing of the ergonomic serving tray, and for further allowing the user to use a single hand for lifting carrying and balancing said ergonomic tray, wherein said second gripping surface includes a designated gripping area allowing other fingers of the user's holding hand other than the thumb to grip therein, wherein the design of said designated gripping area widens from the circumference of the tray towards the center of gravity of the tray, thereby allowing the user to ergonomically place and spread his fingers in said designated gripping area under the thumb a holding configuration in which the thumb is located between and above two edge fingers of the holding hand, and wherein the first gripping surface comprising a plurality of thumb supporting depressions, each said thumb supporting depression is positioned at a different direction.

* * * * *